United States Patent [19]

Kuehnel

[11] 4,171,488

[45] Oct. 16, 1979

[54] X-RAY DIAGNOSIS GENERATOR COMPRISING AN INVERTER FEEDING THE HIGH VOLTAGE TRANSFORMER

[75] Inventor: Werner Kuehnel, Uttenreuth, Fed. Rep. of Germany

[73] Assignee: Siemens Aktiengesellschaft, Berlin & Munich, Fed. Rep. of Germany

[21] Appl. No.: 915,367

[22] Filed: Jun. 14, 1978

[30] Foreign Application Priority Data

Jun. 24, 1977 [DE] Fed. Rep. of Germany ..... 2728563

[51] Int. Cl.[2] ..... H05G 1/12

[52] U.S. Cl. ..... 250/421; 250/408

[58] Field of Search ..... 250/421, 408

[56] References Cited

U.S. PATENT DOCUMENTS 3,207,974 9/1965 McMurray ..... 363/136

3,828,194 8/1974 Grasser ..... 250/408

FOREIGN PATENT DOCUMENTS 2128248 1/1973 Fed. Rep. of Germany .

*Primary Examiner*—Alfred E. Smith

*Assistant Examiner*—T. N. Grigsby

*Attorney, Agent, or Firm*—Hill, Van Santen, Steadman, Chiara & Simpson

[57] ABSTRACT

In the illustrative embodiment, the feeding of the high voltage transformer proceeds from an inverter which is connected to a dc voltage source. The inverter output frequency is adjusted in dependence upon the selected x-ray tube voltage such that as the x-ray tube voltage is reduced, the inverter frequency is correspondingly reduced.

4 Claims, 1 Drawing Figure

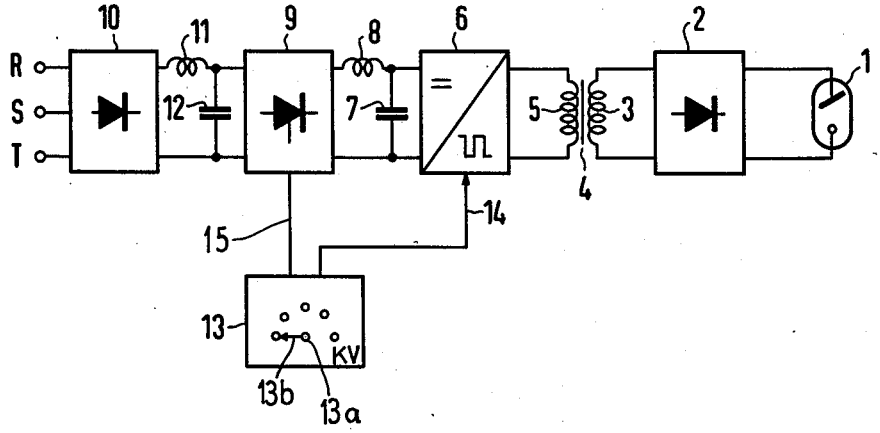
10
11
9
8
6
2
1
R
S
T
12
7
5
3
4
14
15
13
KV
13b
13a

X-RAY DIAGNOSIS GENERATOR COMPRISING AN INVERTER FEEDING THE HIGH VOLTAGE TRANSFORMER

BACKGROUND OF THE INVENTION

The invention relates to an x-ray diagnostic generator comprising and x-ray tube connected to the output of the high voltage transformer, an inverter feeding the high voltage transformer, a dc voltage source connected to the input of the inverter, and means for adjusting the x-ray tube voltage.

An x-ray diagnostic generator of this type is e.g. described in German Offenlegungsschrift No. 2,128,248. In the case of this x-ray diagnosis generator, feeding of the high voltage transformer can take place at a frequency which lies substantially above the mains or supply frequency. It is thereby possible to effect a substantially smaller and more lightweight construction of the high voltage transformer than in the case in which it is operated with the mains frequency; i.e., fed directly from the mains. The dimensioning of the high voltage transformer must proceed such that, at the maximum x-ray tube voltage and the specified frequency of the inverter, the transformer will still by sufficiently far removed from saturation so that the self-heating does not exceed a maximum permissible value.

In the case of such an x-ray diagnosis generator, mainly in the instance in which an x-ray tube voltage is selected which lies below the maximum value, the frequency of the inverter could be reduced without causing an impermissibly high heating of the high voltage transformer, and without having the high voltage transformer reach the point of saturation. A reduction of this type would be useful because the components of the inverter are less subject to stress at a low frequency than at a high frequency.

SUMMARY OF THE INVENTION

Accordingly, the object underlying the invention consists in constructing an x-ray diagnosis generator of the type initially cited such that the stressing (or loading) of the inverter is always only as great as is absolutely necessary with regard to the heating of the high voltage transformer; i.e., wherein the mean (or average) load on the inverter is reduced in comparison with the instance wherein the inverter has a constant output frequency.

In accordance with the invention, this object is achieved in that a control device for the inverter frequency is provided which is constructed in such a fashion that this frequency is adjustable, in dependence upon the selected x-ray tube voltage, such that it is smaller to the extent that the x-ray tube voltage is smaller. In the case of the inventive x-ray diagnosis generator, the above-described fact is taken advantage of in that, at the time when the x-ray tube voltage does not have its maximum value, a frequency reduction is possible without resulting in an impermissible heating of the high voltage transformer. In the case of low frequencies, the components of the inverter are subjected to less stress.

An expedient further development of the invention consists in that the control device is constructed such that the inverter output frequency decreases, subsequent to switching on, from an initial value to a final operating value which is determined by the selected x-ray tube voltage. In this further development, particularly good switching-on conditions of the high voltage transformer are provided; i.e., the occurrence of excessively high transformer currents directly subsequent to the switching-on is avoided.

In the control device, a plurality of steps for the inverter output frequency can be programmed such that the frequency changeover switching proceeds in step-by-step fashion (or gradually) in dependence upon the selected x-ray tube voltage.

The invention is explained in greater detail in the following on the basis of a sample embodiment illustrated in the accompanying sheet of drawings; and other objects, features and advantages will be apparent from this detailed disclosure and from the appended claims.

BRIEF DESCRIPTION OF THE DRAWING

The single FIGURE shows an electric circuit diagram illustrating an embodiment of a medium frequency x-ray generator in accordance with the present invention.

DETAILED DESCRIPTION

In the drawing, an x-ray tube 1 is illustrated which is fed via a high voltage rectifier 2 by the secondary winding 3 of a high voltage transformer 4. The primary winding 5 of the high voltage transformer 4 is connected to the output of an inverter 6 which supplies rectangular (or square-wave) pulses. The input of inverter 6 is connected via a filter 7, 8, to a dc control element 9, to the input of which the output voltage of a three phase rectifier 10 is supplied via a filter 11, 12.

The smoothed (or filtered) dc voltage of the three phase current rectifier 10 is supplied as a series of pulses to the capacitor 7 of filter 7, 8 in dependence upon the desired x-ray tube voltage; i.e., the dc control element 9 manifests a switch which effects a pulsewise connection of capacitor 7 with filter 11, 12. The pulse duty cycle during which capacitor 7 is connected to filter 11, 12, determines the output voltage of the inverter 6 and hence the x-ray tube voltage. This keying (or gating) ratio is adjustable by means of a regulating unit 13 for the x-ray tube voltage.

The output frequency of the inverter 6, which feeds the high voltage transformer 4 with a.c. current pulses of rectangular waveform, is adjustable by a signal at input 14. This signal is supplied by regulating unit 13 for the x-ray tube voltage and is dependent upon the adjusted x-ray tube voltage. In dependence upon the adjusted x-ray tube voltage, the inverter frequency is adjusted such that it has a lower value to the extent that the adjusted x-ray tube voltage is to have a lower value. Several steps for the inverter frequency can here be programmed in regulating unit 13. In the simplest instance, it is conceivable e.g. for the inverter frequency to amount to 4 kHz at x-ray tube voltages which are equal to or greater than 70 kV, and for said inverter frequency to amount to 2 kHz at x-ray tube voltages which are smaller than 70 kV. However, more stages of adjustment, or a continuous variation in the inverter frequency are also conceivable. The inverter is only maximally loaded when it oscillates with its highest frequency. In the case of small x-ray tube voltages, the inverter frequency, and hence the load on the inverter, is reduced without having as a consequence an impermissibly high heating of the high voltage transformer. The frequency naturally may be reduced to such an extent as is permissible with regard to the dimensioning of the high voltage transformer.

In the sample embodiment, wherein the output voltage of the high voltage transformer is formed by approximately trapezoidal pulses, the described frequency control of the inverter has the additional advantage in that the mean value of the dose rate is higher at low inverter frequencies than at high inverter frequencies.

Within the scope of the invention, a closed loop or feedback control (or regulation) of the x-ray tube voltage is also possible instead of an adjustment. In this case, the influencing of the dc. voltage control element 9 proceeds in dependence upon the difference between the actual value and the nominal or set point value of the x-ray tube voltage. The inverter frequency can here be adjusted in dependence upon the respective actual value of the x-ray tube voltage.

In order to adjust or control (or regulate), respectively, the x-ray tube voltage, instead of the dc control element 9, other suitable means—for example, a controlled bridge rectifier with an installation for adjusting the firing angle in connection with the outlet-connected LC-filter 7, 8—may also be used.

It may be noted that U.S. Pat. No. 3,828,194 shows a dc control element for regulating the dc voltage input to an inverter, and that German Auslegeschrift No. 14 38 446 shows in the fourteenth figure an inverter control with a variable resistor for manual adjustment of inverter frequency. For these components, a manual actuator of regulating unit 13 might have a shaft **13*a* coupled to an indicator 13*b* to indicate successive selected voltages at x-ray tube 1; this manual actuator shaft 13*a* being also coupled to a "required value giver" such as designated by reference numeral thirteen in the fourth figure of U.S. Pat. No. 3,828,194, to supply a selected reference value to dc control element 9 via line 15. High voltage rectifier component 2, for example, would include an output voltage divider for supplying an actual x-ray tube voltage value to dc control element 9; this corresponding generally to input fifteen of the fourth figure of U.S. Pat. No. 3,828,194. The outputs such as designated by reference numerals seventeen and eighteen of the fourth figure of U.S. Pat. No. 3,828,194 would then actuate dc control element 9 to maintain the selected high voltage value. According to the present invention, not only would actuator shaft 13*a* be manually rotatable in the clockwise direction as seen in the drawing to select successively higher values of x-ray tube high voltage, but such shaft would be also operative to progressively increase the frequency of operation of inverter 6. For example, the manually adjustable resistor designated by reference numeral one hundred and nine in the fourteenth figure of German Auslegeschrift No. 14 38 446 could be replaced by voltage controlled resistance means responsive to reference voltage value signals selected by manual actuation of shaft 13*a* of component 13 and supplied via input 14** to adjust the inverter frequency to one of five values between two kilohertz and four kilohertz as the high voltage is selected as one of five values between fifty kilovolts and ninety kilovolts, for example.

While component 9 may be any conventional dc voltage control, it may comprise a silicon controlled rectifier switch which is controlled from a control line such as designated by reference numeral eighteen in the fourth figure of U.S. Pat. No. 3,828,194, the control line seventeen being unnecessary because of the smoothness of the dc input from components 10, 11 and 12.

According to an expedient further development, the inverter 6 would always operate at the maximum frequency (e.g. 4 kHz) when operating power was first applied (e.g. to three phase rectifier 10), control according to the setting of actuator shaft **13*a* being effective after a predetermined time delay, the inverter frequency being reduced according to the setting of actuator shaft 13*a* after the expiration of the time delay interval. This could be accomplished by enabling the reference value circuit of unit 13 upon actuation of the exposure trigger switch for initiating an x-ray exposure. The exposure trigger switch actuation would energize a mAs relay which would close the three-phase circuit at R, S and T to supply power to rectifier 10. A timing circuit of unit 13 would respond to the initiation of an exposure to initially supply a maximum reference value signal to input 14 of inverter 6, such reference value signal corresponding to a maximum inverter output frequency. After the time delay, the reference value signal corresponding to the setting of shaft 13*a* would be supplied to input 14. Thus if shaft 13*a* controlled a voltage divider network for supplying successively higher voltages to output 14, the time delay could switch input 14** from a fixed resistor (providing the maximum voltage signal) to the voltage divider output at the completion of the time delay cycle, the time delay circuit being reset at the completion of each exposure.

It will be apparent that many modifications and variations may be effected without departing from the scope of the novel concepts and teachings of the present invention.

I claim as my invention:

1. An x-ray diagnosis generator comprising an x-ray tube connected to the output of a high voltage transformer, an inverter feeding the high voltage transformer, a dc voltage source connected to the input of said inverter, and means for adjusting the x-ray tube voltage, characterized in that a control device (13) for the inverter frequency is provided which is constructed such that the frequency is adjustable, in dependence upon the selected x-ray tube voltage, such that said frequency has a lower value to the extent that the x-ray tube voltage is to have a lower value.

2. An x-ray diagnosis generator according to claim 1, characterized in that the control device (13) is constructed such that the inverter frequency decreases, subsequent to switching on, from an initial value which is the same for all x-ray tube voltages to a final value which is determined by the selected x-ray tube voltage.

3. An x-ray diagnosis generator according to claim 1, characterized in that several stages for the inverter frequency are programmed in the control device (13).

4. An x-ray diagnosis generator according to claim 2, characterized in that several stages for the inverter frequency are programmed in the control device (13).

* * * * *